US007929901B2

(12) United States Patent
Yasuhara et al.

(10) Patent No.: US 7,929,901 B2
(45) Date of Patent: Apr. 19, 2011

(54) RECORDING MEDIUM STORAGE CONTAINER AND IMAGE FORMING APPARATUS

(75) Inventors: Tomoki Yasuhara, Atsugi (JP); Shinichi Kato, Tama (JP)

(73) Assignee: Ricoh Company, Ltd., Tokyo (JP)

( * ) Notice: Subject to any disclaimer, the term of this patent is extended or adjusted under 35 U.S.C. 154(b) by 631 days.

(21) Appl. No.: 11/717,181

(22) Filed: Mar. 13, 2007

(65) Prior Publication Data

US 2007/0217844 A1 Sep. 20, 2007

(30) Foreign Application Priority Data

Mar. 14, 2006 (JP) ..... 2006-069611
Oct. 3, 2006 (JP) ..... 2006-272043

(51) Int. Cl.
*G03G 15/00* (2006.01)
*B25G 3/32* (2006.01)
*B65H 1/04* (2006.01)

(52) U.S. Cl. ..... 399/393; 16/422

(58) Field of Classification Search ..... 399/393; 400/624

See application file for complete search history.

(56) References Cited

U.S. PATENT DOCUMENTS

| | | | | |
|---|---|---|---|---|
| 5,951,078 | A * | 9/1999 | Whitehead et al. | 294/54.5 |
| 2004/0108287 | A1* | 6/2004 | Winig et al. | 211/90.01 |
| 2005/0201792 | A1* | 9/2005 | Park et al. | 399/393 |

FOREIGN PATENT DOCUMENTS

| | | | |
|---|---|---|---|
| JP | 09-194042 | | 7/1997 |
| JP | 10-007267 | | 1/1998 |
| JP | 10-101237 | | 4/1998 |
| JP | 10-157861 | | 6/1998 |
| JP | 2001310825 | A * | 11/2001 |
| JP | 3471529 | | 9/2003 |
| JP | 2004-091126 | | 3/2004 |
| JP | 2005-104716 | | 4/2005 |

OTHER PUBLICATIONS

European Patent Office Search Report dated Jun. 12, 2007, for corresponding European Patent Application No. 07103725.3-2209.

* cited by examiner

*Primary Examiner* — Daniel J Colilla
*Assistant Examiner* — Allister Primo
(74) *Attorney, Agent, or Firm* — Harness, Dickey & Pierce, P.L.C.

(57) ABSTRACT

The invention is directed to a recording medium storage container such as a paper supply cassette and an image forming apparatus such as a copying machine. The paper supply cassette includes an interconnection mechanism for interconnecting a tray and a handle. The interconnection mechanism includes a connection portion having cylindrical protrusions, a connection portion having cylindrical protrusions, and a plurality of locking portions. The connection portions are connected from a upward and downward direction that is different from a direction for drawing the tray from the copying machine, or a direction for inserting the tray into the copying machine.

14 Claims, 10 Drawing Sheets

RECORDING MEDIUM STORAGE CONTAINER AND IMAGE FORMING APPARATUS

PRIORITY CLAIM

This application claims priority from Japanese Patent Application No. 2006-069611 filed on Mar. 14, 2006 and Japanese Patent Application No. 2006-272043 filed on Oct. 3, 2006, both with the Japanese Patent Office, the contents of which are incorporated herein by reference in their entirety.

BACKGROUND OF THE INVENTION

1. Field of the Invention

The invention relates to a recording medium storage container and an image forming apparatus for storing copy sheets in an image forming apparatus.

2. Description of the Related Art

Conventionally, a small-sized image forming apparatus such as a copying machine, printer, and facsimile includes a paper supply cassette for storing sheets of paper to be used for copying. The paper supply cassette can be removed from the image forming apparatus, by pulling out a handle provided on the image forming apparatus and the paper supply cassette. The paper supply cassette is of a box and has an opening for storing the sheets at the upper portion of the paper supply cassette. Opening a cover covering the opening allows the sheets to be stored.

Recently, the image forming apparatus including a printer tends to be downsized. To cope with the situation, the paper supply cassette needs to be downsized, too. Because of this, a resin molded type of paper supply cassette in which a handle is integrally provided is in great demand.

Japanese Patent Publication 2005-104716 (Patent Document 1) discloses a paper supply cassette, which stores a plurality of sheets of paper to be sent to the apparatus. The paper supply cassette includes a paper storage unit for storing sheets of paper, a plurality of resin molded frame members for locating the paper storage unit in the body, and a connection member for integrating by interconnecting a plurality of frame members.

The paper supply cassette of Patent Document 1 can make the resin molded frame members smaller. As a result, even if the complex mold that uses rib formation many times is not used, occurrence of shrinkage phenomena at a time of forming resin can be prevented. This enables the frame members having high precision to be easily manufactured, and by integrating them, the paper supply cassette as a whole to obtain high precision.

Japanese Patent Publication Hei 10-157861 (Patent Document 2) is directed to an image forming apparatus. The image forming apparatus includes a detachable rail provided with the left and right side walls, respectively, of the paper supply cassette that is of a box and is to be inserted therein. Furthermore, the image forming apparatus includes an exterior portion on a withdrawing side fastened by a screw on a vertical wall located outside of the image forming apparatus. The exterior portion functions as a handle. With respect to the direction in which the handle is fastened by the screw, there are two directions: a direction in which the paper supply cassette is attached and detached, that is, a direction of attaching and detaching the paper supply cassette, and an upward and downward direction.

Japanese Patent Publication Hei 9-194042 (Patent Document 3) discloses a vertical handle that extends to the direction of attaching and detaching the paper supply cassette, and a horizontal handle that extends orthogonal to the direction of attaching and detaching the paper supply cassette. The vertical handle is mounted on both of the sidewalls of the paper supply cassette, respectively, while the horizontal handle is mounted on a vertical wall locating on an operator's side. A cross shape of rails are formed outside of a bottom wall of the paper supply cassette.

Japanese Patent No. 3471529 (Patent Document 4) is directed to a paper supply cassette. The paper supply cassette of Patent Document 4 includes a case unit for storing sheets of paper, and a handle that is divisible with the case unit. The handle mounted on a side face of a copying machine can be used as a manual paper feeder.

However, as in Patent Document 1, a resin forming product, which integrates the cassette and the handle, renders a forming die thereof larger and a forming cycle time thereof longer because of a complex shape.

In Patent Document 2, since a screw is fastened in a direction of attaching and detaching the cassette (also called a "cassette attaching and detaching direction") with respect to the image forming apparatus and in a direction orthogonal to the cassette attaching and detaching direction, a boss for fastening a screw is formed on the back side of the handle, which makes complicated a structure of the back side of the handle.

The paper supply cassette of Patent Document 3 similarly connects the cassette with the handle by the screw, rigidity needs to be increased for attaching and detaching the cassette, with the handle held firmly. For accomplishing this, thickness of the cassette and the handle need to be increased, and shrinkage has to be prevented.

Moreover, as in Patent Document 4, even when the handle and the cassette are divided, rigidity of the handle needs to be increased for attaching and detaching the cassette to and from the image forming apparatus, respectively. In addition, thickness of the cassette and the handle need to be increased, and shrinkage has to be prevented.

Accordingly, in order to make the paper supply cassette downsized, when the handle and the cassette are downsized and interrelated, it is difficult to secure a space for an interconnection mechanism of the cassette itself and the handle. Where an interconnection mechanism dares to be provided and the handle and the cassette dare to be interconnected, it is difficult to secure sufficient strength for the interconnection mechanism with respect to a force applied at the handle, to remove the paper supply cassette.

Because the handle includes an exterior portion, good quality in external appearance such as shrinkage, luster or texture is required. Therefore, where a highly precise and complicated dice is necessary, there is a problem that manufacturing cost will be high.

For the foregoing reasons, there is a need for a recording medium storage container that, even when the recording medium storage container is provided separately from a handle, can be compact and secure sufficient strength in an interconnection portion between the recording medium storage container and the handle. The recording medium storage container, although compact, has a simple structure and a good quality in an external appearance. Moreover, there is also a need for an image forming apparatus that includes the recording medium storage container described above.

SUMMARY OF THE INVENTION

The present invention is directed to a recording medium storage container and an image forming apparatus that satisfy this need. One aspect of the invention relates to a recording medium storage container for an apparatus The recording medium storage container comprises an recording medium storage unit for storing a recording medium, the recording medium storage unit being attachable to and detachable from the apparatus and a handle unit for drawing the recording medium storage unit, wherein the recording medium storage unit and the handle unit are individually formed and constitute the recording medium storage container using an interconnection mechanism. The interconnection mechanism comprises connection portions for connecting the recording medium storage unit and the handle unit from a direction that is different from an attachable and detachable direction of the recording medium storage unit into the apparatus; and locking portions for simultaneously locking the recording medium storage unit and the handle unit at the time of the connecting.

Advantageously, the connection portions include cylindrical portions located inside and cylindrical portions located outside.

Advantageously, the connection portions are connected by a spiral screw in a direction that is different from the attachable and detachable direction toward the apparatus.

Advantageously, the connection portions are connected with the recording medium storage unit downward.

Advantageously, the connection portions are at least one pair formed in a horizontal direction on each of the recording medium storage unit and the handle unit.

Advantageously, the locking portions are at least one pair formed in a horizontal direction on each of the recording medium storage unit and the handle unit.

Advantageously, the connection portions include a disconnection prevention mechanism that prevents the recording medium storage unit and the handle unit being disconnected once they are connected.

Advantageously, an image forming apparatus comprises a recording medium storage container.

BRIEF DESCRIPTION OF THE DRAWINGS

These and other features, aspects, and advantages of the present invention will become better understood with regard to the following description, appended claims, and accompanying drawings.

DETAILED DESCRIPTION OF THE INVENTION

Referring to the figures, embodiments of a paper supply cassette as a recording medium storage container and an image forming apparatus thereof in accordance with the invention will be discussed herein below.

Figure 8:
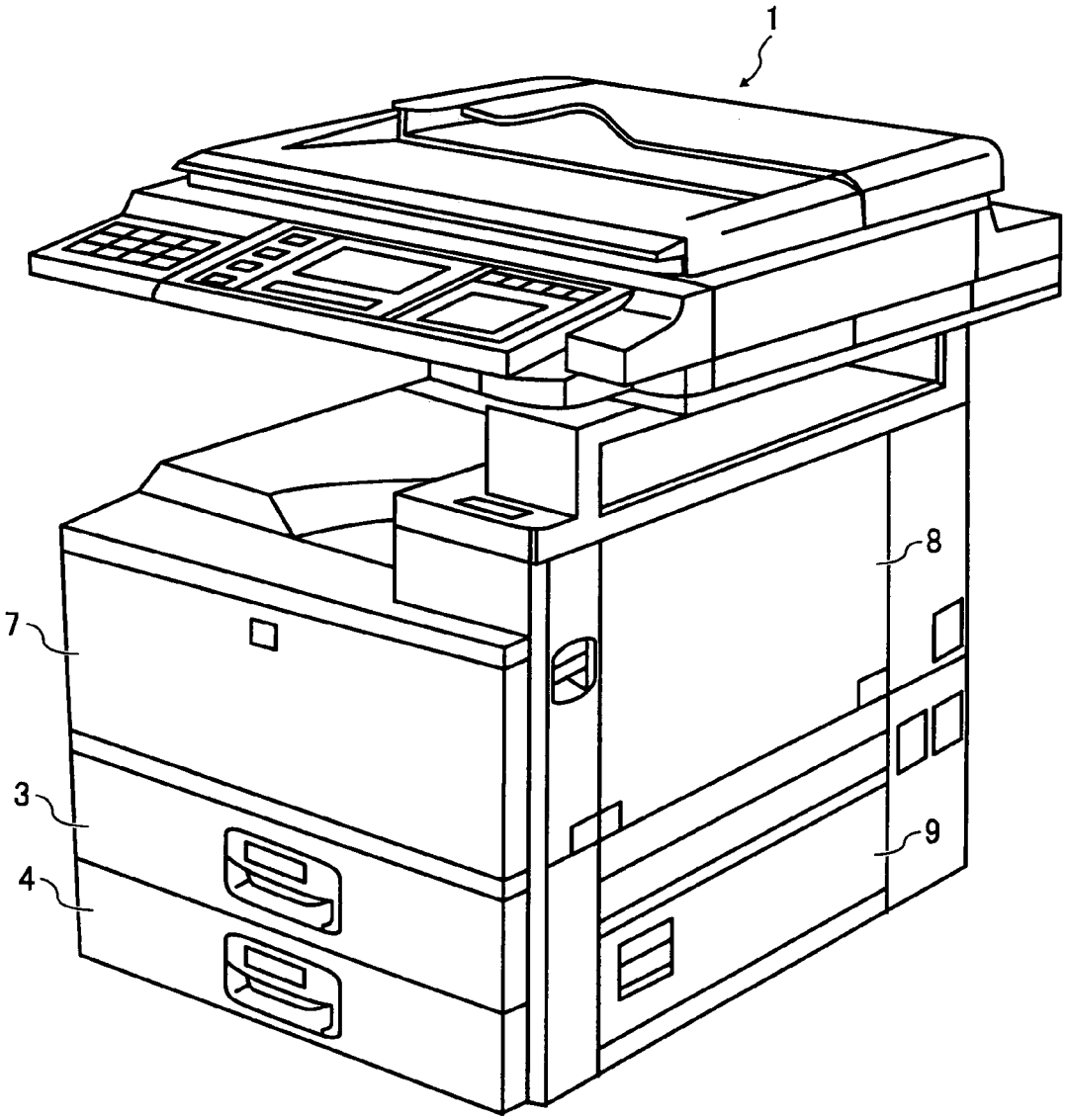
FIG. 8 is a perspective view of a copy machine as a first example of an image forming apparatus pertaining to one embodiment in accordance with the present invention.
Figure 9:
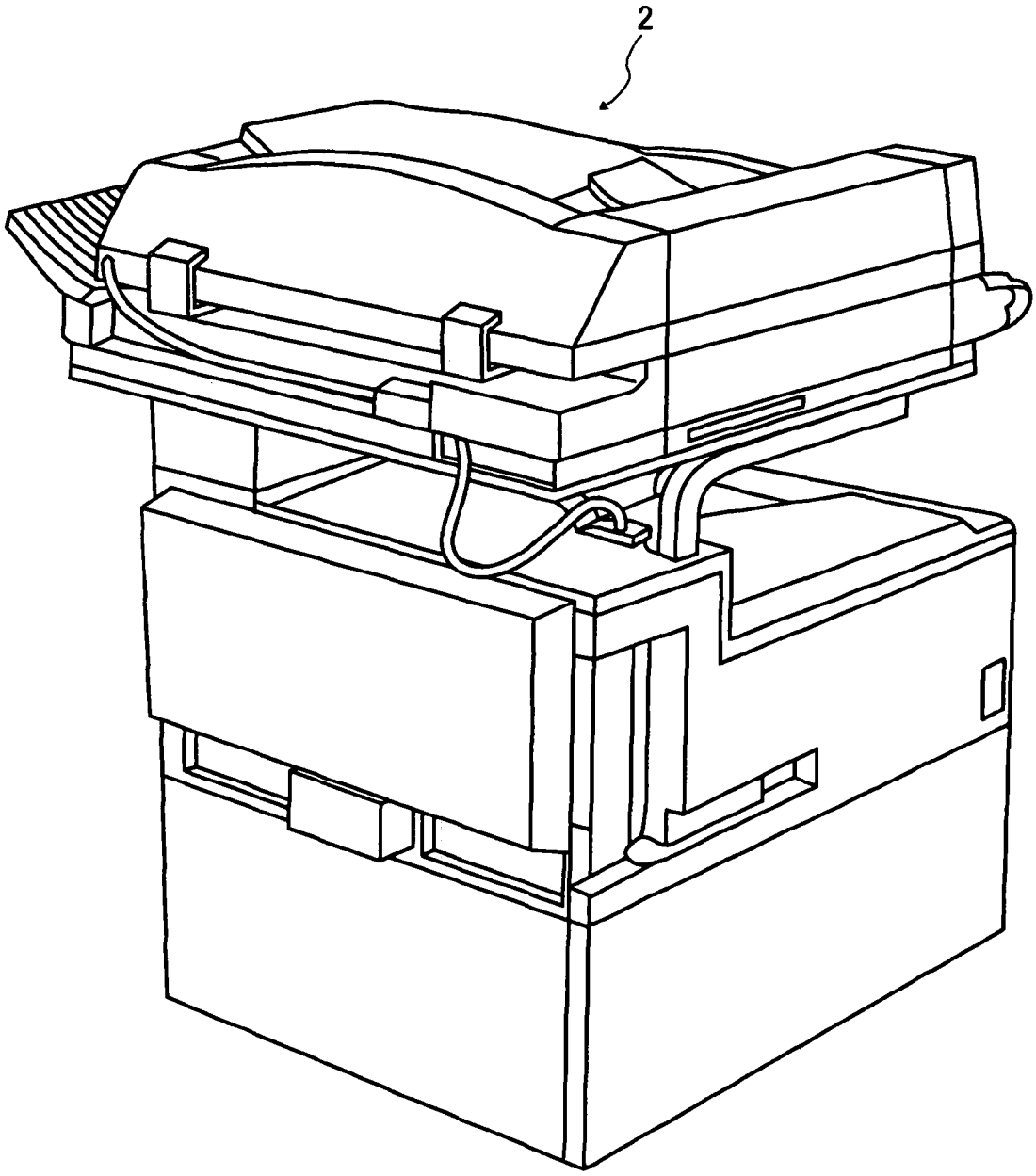
FIG. 9 is a perspective view of a copy machine as a second example of an image forming apparatus pertaining to one embodiment in accordance with the present invention.

FIGS. 8 and 9 show copying machines 1 and 2 as an image forming apparatus, respectively, in accordance with embodiments of the invention. The copying machines 1 and 2 include paper supply cassettes 3 and 4 as a recording medium storage container for storing sheets of paper that are used to be copied. The paper supply cassettes 3 and 4 have different shapes based on a type of the copying machines 1 and 2, but are common in that they include a tray 5 and a handle 6, respectively, that constitute a recording medium storage container. Therefore, an explanation is made of the paper supply cassette 3 only, not the paper supply cassette 4.

Figure 10:
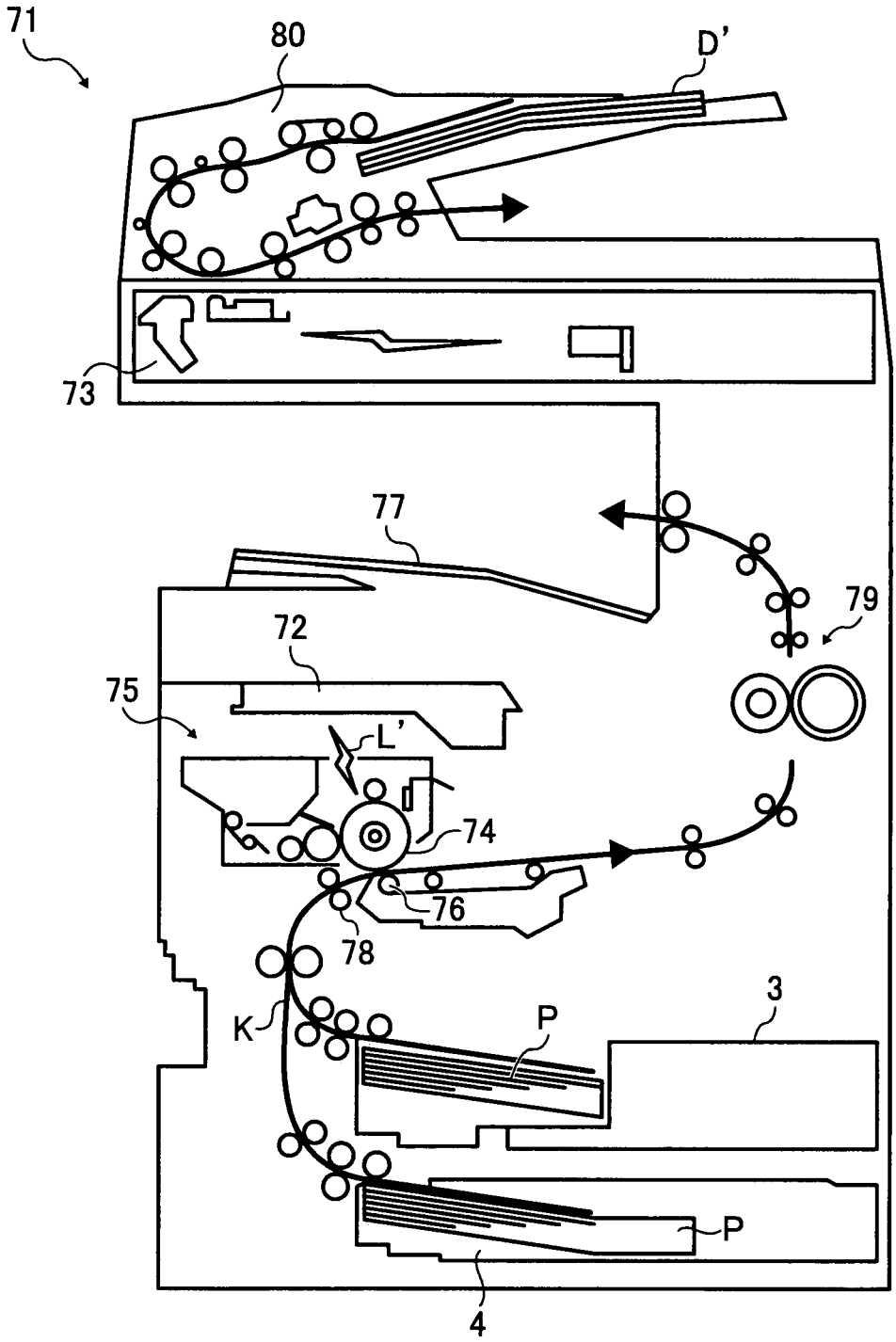
FIG. 10 is an illustrative view of a structure of the second example of an image forming apparatus pertaining to one embodiment in accordance with the present invention.

The entire structure and operation of an image forming apparatus is explained based on FIG. 10, taking the copying machine 2 as one example.

In FIG. 10, reference numeral 71 denotes the body of the copying machine 2 as an image forming apparatus; 72, an exposure unit for illuminating to a photosensitive drum 74 exposure light L' including image information derived by exposing light to a document reading unit 73; 75, a process cartridge detachably mounted to the body 71 for forming an image; 76, a transfer unit for transferring a toner image formed on the photosensitive drum 74 to a recording medium P; 77, an output tray for outputting the recording medium P having a transferred image; 81, a conveyance arrangement itself including 78, a register roller, for conveying the recording medium P to the transfer unit 76; 79, a fuser unit for fusing the unfused image on the recording medium P; 80, a document conveyance unit for conveying a document D' set to the document reading unit 73; 3, a paper supply tray (storing container) for storing a recording medium (an item to be stored) such as sheets of transfer paper.

Referring to FIG. 10, operation in forming an ordinary image of the image forming apparatus is explained herein below.

The document D' is conveyed in an arrow direction shown in the figure from a document rack by a transport roll of the document conveyance unit 80 to pass over the document reading unit 73. At this time, the document reading unit 73 optically reads image information of the document D' that passes above it.

The optical image information read by the document reading unit 73 is converted to an electrical signal to be sent to the exposure unit 72 (writing unit). The exposure untie 72 illuminates exposure light L' of laser onto the photosensitive drum 74 based on the image information of the electrical signal.

On the other hand, the photosensitive drum 74 rotates counterclockwise in the figure and forms a toner image commensurate with the image information on the photosensitive drum 74, through predetermined electro-photographic processes (a charging process, exposure process, and image development process). Then, the toner image on the photosensitive drum 74 is transferred onto the recording medium P conveyed by the register roll 78, in the transfer unit 76.

Not shown in the figure, the process cartridge 75 is integrally provided with the photosensitive drum 74, a charging unit for charging the surface of the photosensitive drum 74, a development unit containing toner (development agent) for developing an electrostatic latent image formed on the photosensitive drum 74, and a cleaning unit for cleaning untransferred toner remaining on the photosensitive drum 74.

By the way, the recording medium P to be transferred to the transfer unit 76 behaves as follows.

One of a plurality of paper supply trays 3 for the apparatus itself is selected either automatically or manually. For example, it is assumed that an upper most paper supply tray 3 is selected.

One upper most sheet of the recording medium P stored in the paper supply tray 3 is conveyed to a conveyance path K. Later, the recording medium P reaches the register roll 78 past the conveyance path K. When the recording medium P has reached the register roll 78, it is conveyed to the transfer unit 76, fixing the timing, in order to align the toner image formed on the photosensitive drum 74.

After the transfer process, the recording medium P arrives at the fuser unit 79 through the conveyance path after passing the transfer unit 76. The recording medium P that has reached the fuser unit 79 is inserted between a fuser roll and a pressing roll, where the toner image is fused by the heat from the fuser roll and the pressure from the pressing roll. The recording medium P, on which the toner image is fused, is sent out from between the fuser roll and the pressing roll, and then is discharged as an output image from the body 71 to be placed on the output tray 77. In this way, a series of image forming processes is complete.

The body 71, as one embodiment, represents the copying machine 2 as an image forming apparatus, but is not limited to the copying machine 1, another type of copying machine, a digital copier, or a printer as long as a paper supply cassette provided therewith can be detachable.

Taking the copying machine 1 as one example, a recording medium storage container and an image forming apparatus in accordance with the invention will be described.

The copying machine 1 includes a paper supply cassette 3. The paper supply cassette 3 can be made compact, and has a strong interconnection, a simple structure and a good quality in external appearance.

The paper supply cassette 3 is designed to be able to be withdrawn from a side of the body of the copying machine 1. The paper supply cassette 3 includes a tray 5 for storing new sheets of paper to be used for copying, and a handle 6 facing outward of the copying machine 1. Reference numeral 7 represents a hinge door for inspecting and fixing that is provided on the front of the copying machines 1 and 2, respectively; reference numeral 8, a hinge door for manually supplying sheets of paper that is provided on the back of the copying machines 1 and 2, respectively; and reference numeral 9, a cover (hinge door) for inspecting and fixing the copying machines 1 and 2.

Figure 1A:
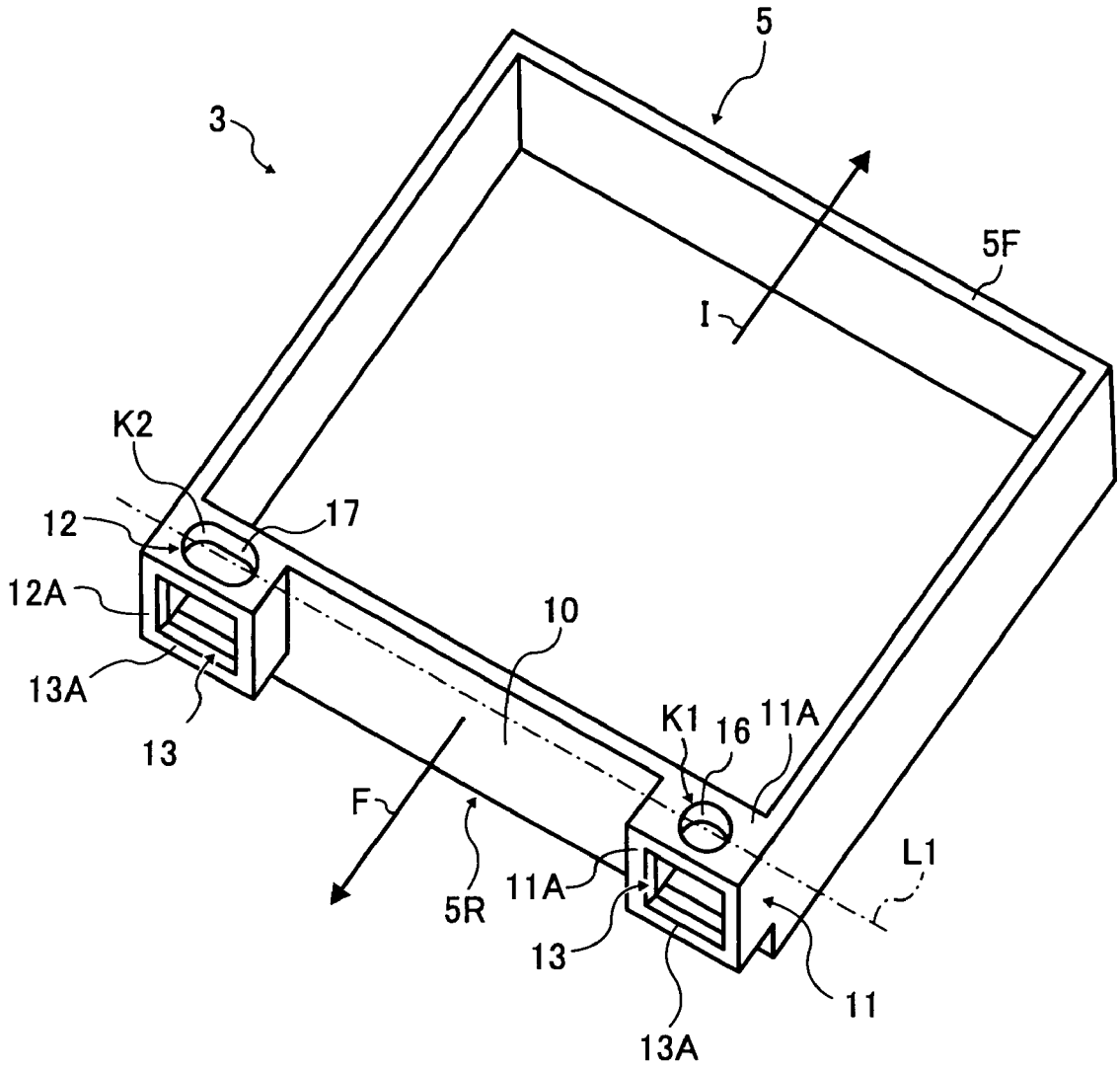
FIG. 1A is an illustrative view of a tray for a paper supply cassette in accordance with a first embodiment of the invention.
Figure 1B:
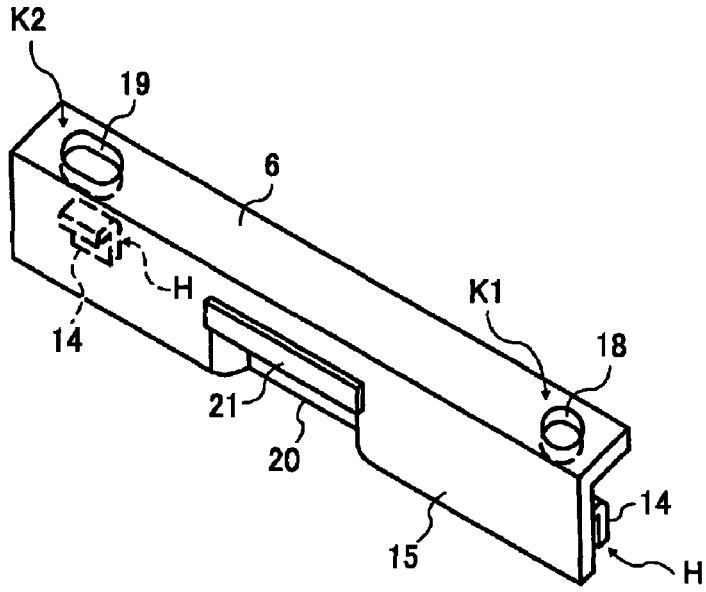
FIG. 1B is an illustrative view of a handle for the paper supply cassette of in accordance with the first embodiment.
Figure 1C:
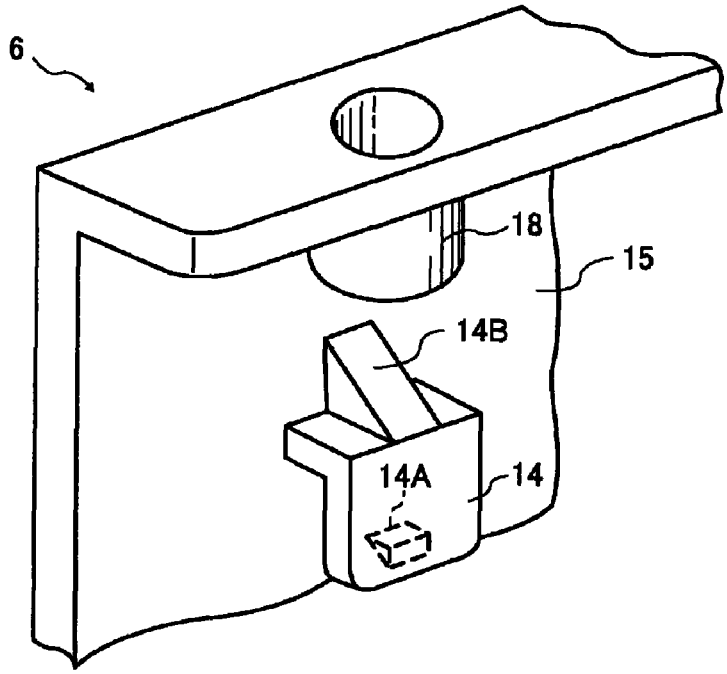
FIG. 1C is a partial perspective view of a nail portion and a vertical wall of a locking portion formed on the handle.

FIGS. 1A, 1B and 1C are an illustrative view of a tray for a paper supply cassette 3 in accordance with a first embodiment of the invention. The paper supply cassette 3 includes a tray 5 and a handle 6. The tray 5 has a shape of a box for storing sheets of paper to be fed to a transfer unit and a fuser unit (both not shown) of a copying machine 1.

Symbol F represents a drawing direction for drawing, or pulling out the tray 5 from the copying machine 1, while symbol I indicates an insertion direction for inserting the tray 5 into the copying machine 1. A symbol 5F of the tray 5 represents an end for the insertion direction, i.e., an insertion direction end, into the copying machine 1, and a symbol 5R side in the tray 5 indicates an end for the drawing direction, i.e., a drawing direction end, from the copying machine 1. The drawing direction F and the insertion direction I both stand for an attaching and detaching direction.

Box shapes 11 and 12 are formed, respectively, near both of a left end and a right end of a vertical wall 10 formed on the drawing direction end 5R of the tray 5. The box shapes 11 and 12 protrude toward the drawing direction F of the tray 5 from the vertical wall 10. The lower sides of the box shapes 11 and 12 are open. Vertical walls 11A and 12A of the box shapes 11 and 12 have rectangular apertures 13 constituting a locking portion. A lower end 13A of the aperture 13 is one of the locking portions. The other of the locking portion is a nail portion 14 of the handle 6. The nail portion 14 protrudes from a vertical wall 15 of the handle 6, and, when connected with the aperture 13, sandwiches the lower end 13A of the aperture 13 with a pressable interval.

Figure 2A:
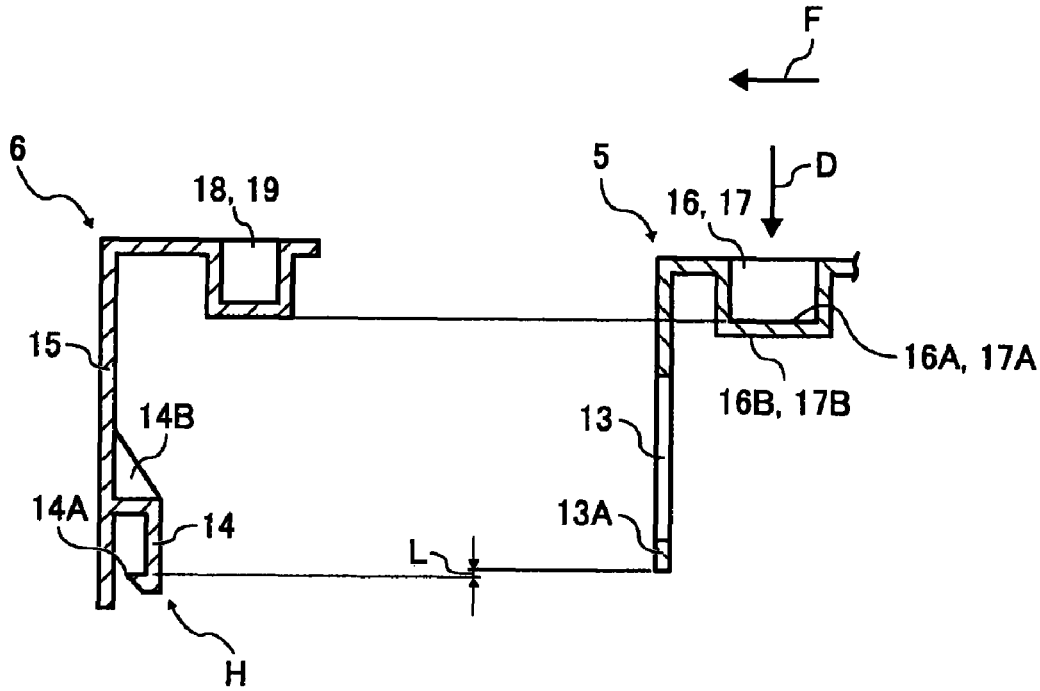
FIG. 2A is a cross-sectional view of a tray and a handle shown in FIGS. 1A-1C before connected.
Figure 2B:
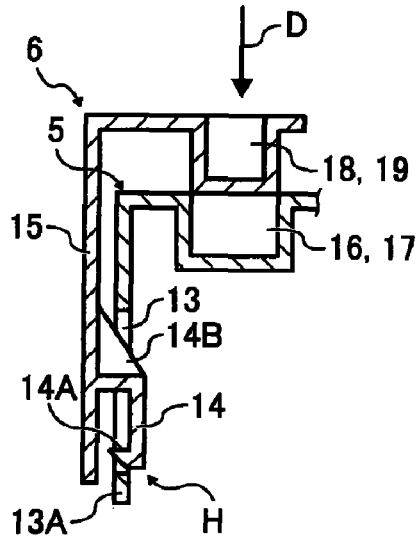
FIG. 2B is a cross-sectional view of the tray and the handle when almost fully interconnected.

FIG. 2A is a cross-sectional view of the tray and the handle shown in FIGS. 1A-1C when they are placed individually. FIG. 2B is a cross-sectional view of the tray and the handle when they are almost completely connected.

As shown in FIG. 2A, a reversed portion 14A is formed inside the tip of the nail portion 14. When the nail portion 14 is connected with the aperture 13, the reversed portion 14A embraces the lower portion of the lower end 13A of the tray 5 to prevent the lower end 13A from coming out. Reference numeral 14B is an enforcement portion that prevents bending deformation of the nail portion 14.

The tray 5 and the handle 6 are interconnected as follows as one example, referring to FIG. 2A. The handle 6 is moved rightward toward the tray 5 that is fixed. When the handle 6 comes close to the tray 5, the handle 6 should be moved upward and moved further rightward closer to the tray 5, so that the cylindrical protrusions 18 and 19 of the handle 6 come just over the concave portions 16 and 17 of the tray 5. Then, the handle 6 is moved downward as shown by D to a position shown in FIG. 2B, where the cylindrical protrusions 18 and 19 of the handle 6 is almost fit into the concave portions 16 and 17 of the tray 5, respectively. Moreover, the handle 6 is moved further downward until the cylindrical protrusions 18 and 19 touch the cylindrical protrusions 16A and 17A respectively. This is how the tray 5 and the handle 6 are interconnected.

As can be understood from FIG. 2B, when the tray 5 constitutes a complete interconnection with the handle 6 and when the nail portion 14 and the vertical wall 15 have sandwiched the lower end 13A of the box shape 11, the reversed portion 14A is formed to be placed lower by a distance L than the lower end 13A, so that the reversed portion 14A embraces the lower portion of the lower end 13A.

A cylindrical concave portion 16 is formed on the upper plate 11A of the box shape 11. The aperture shape of the concave portion 16 is a circle, but is not limited to it. It may be a polygon or ellipse. A cylindrical concave portion 17 is formed that constitutes one of the connection portions. The aperture shape of a concave portion 17 is an elliptical long hole larger than the concave portion 16. The aperture shape may be in the concave portion 17, and may be a circle identical to that of the concave portion 16, a square aperture, not a long-hole aperture, or a shape with the corners chamfered. The length of a minor axis of the concave portion 17 is set to be identical to that of the concave portion 16, while the length of a major axis of the concave portion 17, which extends in the direction of the longer side of the plane of the vertical wall 10, is set to be longer than that of the concave portion 16.

The concave portions 16 and 17 include as the outer circumference thereof cylindrical protrusions 16A and 17A, respectively, that protrude downward from the upper board 12A. As shown in FIG. 2A, bottoms 16B and 17B of the concave portions 16 and 17 represent the bottom of the cylindrical protrusions 16A and 17A, respectively. The cylindrical protrusions 16A and 17A constitute a connection portion on the side of the tray 5.

As shown in FIGS. 1A-1C, a central portion of the concave portions 16 and 17 lies on line L1 parallel to the vertical wall 10. This structure absorbs a shift, even when a connection position or space of the left and right connection portions is shifted in the direction of the longer side of the vertical wall 10 on account of molding or assembling. Accordingly, the structure is able to prevent poor assembling.

A connection portion on the side of the handle 6 shown in FIGS. 1A-1C and 2A is cylindrical protrusions 18 and 19 located on the right and left ends of the handle. The cylindrical protrusions 18 and 19 include a cylindrical shape that has a bottom. Moreover, the cylindrical protrusions 18 and 19 have an identical diameter, respectively. The cylindrical protrusion 18 is connected with the concave portion 16, while the cylindrical protrusions 19 are connected with an end portion in the direction of the short axis of the concave portion 17.

The tray 5 and the handle 6 include two connection portions K1 and K2, respectively. The connection portions K1 and K2 constitute part of an interconnection mechanism for interconnecting the tray 5 and the handle 6. The connection portion K1 includes the cylindrical protrusion 16A and the cylindrical protrusion 18, while the connection portion K2 includes the cylindrical protrusion 17A and the cylindrical protrusion 19. These connection portions K1 and K2 connect the tray 5 and the handle 6 by connecting each other from an upward and downward direction D. The direction for connecting the connection portions K1 and K2 is designed to be the upward and downward direction D, which is different from the drawing direction F that is one of the attaching and detaching directions for the paper supply cassette 3. Because the cylindrical portions are inserted and fastened, the connection portions K1 and K2 have high rigidity and prevent disengagement of the tray 5 and the handle 6.

The nail portion 14 and the vertical wall 15 constitute a locking portion H that is part of the interconnection mechanism for the tray 5 and the handle 6. Since the locking portions H including the nail portion 14 and the vertical wall 15 on the left and right ends of the handle 6 are formed, respectively, and an insertion is performed from the upward and downward direction D, the locking portions H are fastened on the vertical wall 10 of the tray 5 even when a force is applied in the drawing direction F with respect to the vertical wall 15 of the handle 6.

This prevents the vertical wall 15 of the handle 6 from coming off from the tray 5, bending or deteriorating external quality. A concave portion 20 is formed in the lower surroundings of a central portion of the vertical wall 15 of the handle 6. A drawer pull 21, at which a finger or fingers are put, is formed on the concave portion 20.

FIG. 2B shows a situation in which the tray 5 and the handle 6 are interconnected by the interconnection mechanism constituting the connection portions K1 and K2 and the locking portion H of FIGS. 1A-1C. As shown in FIG. 2B, when the handle 6 is connected to the tray 5, the handle 6 should first be located with respect to the tray 5 so that the cylindrical protrusions 18 and 19 of the handle 6 is situated upward of the concave portions 16 and 17 of the tray 5. Then, the nail portion 14 of the handle 6 should be inserted into the aperture 13 of the box shape 11 and 12. Moreover, the handle 6 is lowered along the upward and downward direction D to be pressed on the side of the tray 5. This causes the lower end 13A of the aperture 13 to be inserted between the nail portion 14 and the vertical wall 15. At the same time, the cylindrical protrusions 18 and 19 are also inserted into the concave portions 16 and 17 of the tray 5. Owing to this, the connection portions K1 and K2, which include the cylindrical protrusions 18 and 19 and the concave portions 16 and 17, respectively, are interconnected. In addition, the locking portion H, which includes the nail portions 14 on the left and right ends and vertical walls 15 corresponding thereto, catches and is connected to the lower end 13A.

In this way, as the interconnection mechanism for connecting the tray 5 and the handle 6, the paper supply cassette 3 includes the connection portion K1 having the cylindrical protrusions 18 and 16A, K2 having the cylindrical protrusions 19 and 17A, and a plurality of locking portions H. The cylindrical protrusions 18 and the connection portion K1 of the concave portion 16, the cylindrical protrusions 19 and the connection portion K2 of the concave portion 17 are mutually caught from the upward and downward direction D that is not inconsistent with the drawing direction F or the loading direction I of the tray 5 of the copying machine 1.

For the reason, the connection and the mutual catching of the tray 5 and the handle 6 can be done simultaneously. Because cylindrical protrusions 18 and 16A are connected, high rigidity is obtained with respect to a shear force of a withdrawing force. Consequently, even when the paper supply cassette 1 is made compact, or the space between the tray 5 and the handle 6 is made smaller, the tray 5 and the handle 6 are designed individually and easily, and sufficient strength can be obtained against a manipulative force applied to the handle 6.

Moreover, because the interconnecting mechanism can be formed to be small, without the handle 6 easily coming off from the tray 5, precise molding tends to be performed to improve external appearance and quality.

The connection portion K1 includes the cylindrical protrusion 16A and the cylindrical protrusion 18, while the connection portion K2 is composed of the cylindrical protrusion 17A and the cylindrical protrusion 19. Therefore, when K1 and K2 are connected, the cylindrical protrusions 16A and 18 become double. When the tray 5 is tried to be pulled out of the copying machine 3, a shear force applied to the connection portions K1 and K2 does not easily transform or damage the paper supply cassette, which can be solidly interconnected.

The interconnection mechanism for the tray 5 and the handle 6 includes the connection portions K1 and K2, and the locking portion H having the nail portion 14 and the vertical wall 15. Accordingly, when a force is applied to separate the tray 5 and the handle 6, deformation in the lower end or both the side ends of the vertical wall 15 is prevented.

Since the tray 5 and the handle 6 are a separate part, the material of the tray 5 and the handle 6 can be arbitrarily changed according to cost-cutting, or various specifications or requirements. For example, highly incombustible material can be used for the handle 6, while low incombustible, low-cost material can be selected for the tray 5, which can reduce the cost in total.

Since the tray 5 and the handle 6 are a separate part, when a design of the exterior cover is planning to be changed, only the shape or color of the handle 6 can be changed and the tray 5 does not need to be altered. This enables a design change.

The connection portions K1 and K2 are established as one pair at the left and right ends on the top surface of the handle 6, and the locking portions H having the nail portion 14 and the vertical wall 15 are also formed as one pair on the left and right of the handle 6. Therefore, even when the tray 5 is fully loaded with sheets of paper or the handle 6 is held with the paper supply cassette 3 removed from the copying machine 1, the interconnection between the tray 5 and the handle 6 does not come off.

Since the tray 5 and the handle 6 are a separate part, the invention produces an advantage that they are not bulky in transporting them in a pile during manufacturing process. When the handle 6 is drawn, an almost equal force is applied to the left and right of the handle 6. Consequently, deformation can be prevented that the handle 6 experiences in a direction detaching the tray 5, and deformation deviated either left or right can also be prevented that the handle 6 experiences.

Figure 3A:
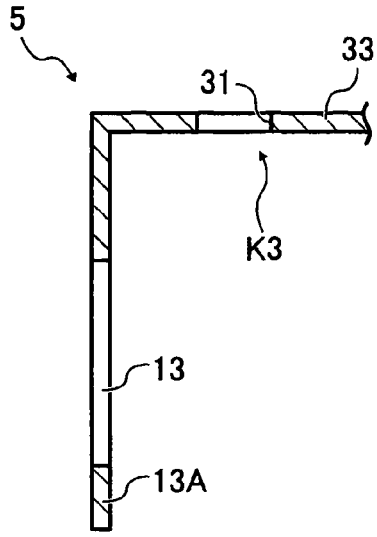
FIG. 3A is a cross-sectional view of a tray for a first variant of the first embodiment shown in FIGS. 1A-1C.
Figure 3B:
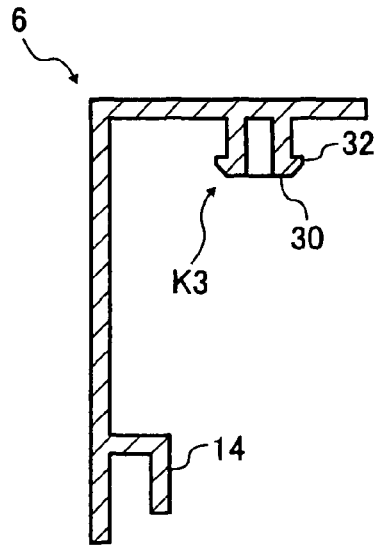
FIG. 3B is a cross-sectional view of a handle for a first variant of the first embodiment.

FIG. 3A is a cross-sectional view of a tray for a first variant of the first embodiment shown in FIGS. 1A-1C. FIG. 3B is a cross-sectional view of a handle for a first variant of the first embodiment. The tray and the handle for the first variant constitute an interconnection mechanism.

In FIGS. 3A and 3B, a connection portion K3 includes a protrusion 30 having a guard (called herein below a "guard-having protrusion") on the handle 6 and a hole 31 in the handle 6. The interconnection mechanism of FIGS. 3A and 3B is composed of the connection portion K3 and a locking portion H.

The connection portion K3 includes the guard-having protrusion 30 that disables the handle 6 to be detached once it has been attached—a disconnection prevention mechanism. The guard-having protrusion 30 is designed to be through the hole 31. The distance from a reversed portion 32 of the guard-having protrusion 30 to the base is larger than a thickness of an upper board 33 of the handle 6. When the guard-having protrusion 30 is put through the hole 31, the reversed portion 32 projects from the lower end of the hole 31. This disenables the handle 6 to be pulled out. Since the structure of the nail portion 14 and the vertical wall 15 constituting the locking portion H is identical to that shown in FIGS. 1A-1C and 2A, an explanation thereof is not made.

According to the interconnection mechanism of FIG. 3, once the connection portions K3 are mutually connected, because pulling out the handle 6 is disenabled, a connection force is strong and a screw for fastening is not needed. This brings about less part cost and working labor, which leads to reduction of manufacturing cost.

Figure 4:
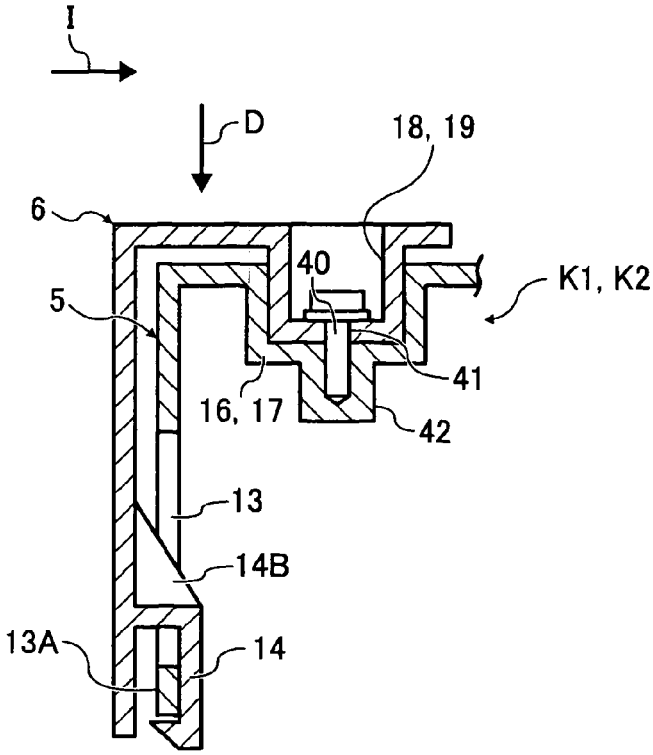
FIG. 4 is a cross-sectional view of an interconnection mechanism including a tray and a handle for a second variant of the first embodiment shown in FIGS. 1A-1C.

FIG. 4 is a cross-sectional view of an interconnection mechanism including a tray 5 and a handle 6 for a second variant of the first embodiment. In FIG. 4, the cylindrical protrusions 16A and 18 of the connection portion K1 and the cylindrical protrusions 17A and 19 of the connection portion K2 in FIGS. 1A-1C and 2A are further fastened by a screw 40. The interconnection mechanism of FIG. 4 includes the connection portions K1 and K2, and the locking portion H. A through hole 41 for the screw 40 is formed on the cylindrical protrusion 16A, while a boss 42 having screw threads is provided on the cylindrical protrusion 18.

The cylindrical protrusions 16A and 18 and the cylindrical protrusions 17A and 19 are fastened, respectively, by the screw 40 in the upward and downward direction. The screw 40 fixes the cylindrical protrusions 16A and 18 and the cylindrical protrusions 17A and 19 in the upward and downward direction D that is different from the attaching and detaching direction of the paper supply cassette 3 (the drawing direction F and inserting direction I of FIG. 1A).

Because of this, the screw 40 does not receive a force applied in the drawing direction F and inserting direction I of the paper supply cassette 3, and the double cylinders of the cylindrical protrusions K1 and K2 overlap. Hence, rigidity is high.

Because the structure of the nail portion 14 and the vertical wall 15 constituting the locking portion is the same as that shown in FIGS. 1A-1C and 2A, no explanation thereof is made.

Figure 5C:
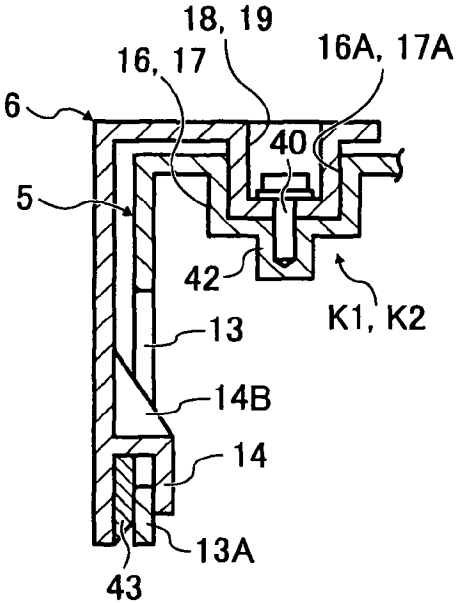
FIG. 5C is a cross-sectional view of an interconnection mechanism including the tray and the handle for a third variant.
Figure 5B:
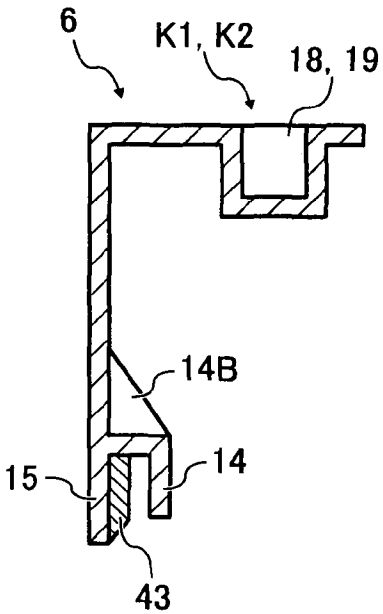
FIG. 5B is a cross-sectional view of a handle for a third variant of the first embodiment.
Figure 5A:
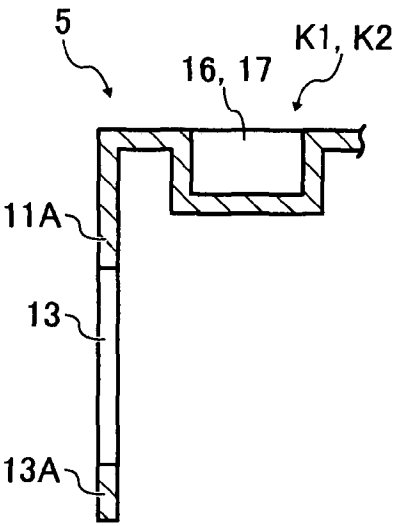
FIG. 5A is a cross-sectional view of a tray for a third variant having a spacer of the first embodiment shown in FIGS. 1A-1C.

FIG. 5A is a cross-sectional view of a tray for a third variant having a spacer of the first embodiment shown in FIGS. 1A-1C. FIG. 5B is a cross-sectional view of a handle for a third variant of the first embodiment. FIG. 5C is a cross-sectional view of an interconnection mechanism including the tray and the handle for a third variant.

FIGS. 5A and 5B are derived by replacing the nail portion 14 and the vertical wall 15 of the interconnection mechanism in FIG. 4 with another structure. The structure includes the connection portions K1 and K2 and the locking portion H in FIG. 4, and further a spacer 43 attached to the vertical wall 15 opposite to the nail portion 14. The corner of the lower end of the spacer 43 is chamfered diagonally. The spacer 43 sandwiches the lower end 13A of the tray 5 to be inserted between the nail portion 14 and the vertical wall 15. Since the rest of the structure is identical to the interconnection mechanism in FIG. 4, no explanation thereof is made. The both sides of the spacer 43 may be adhesive so that the lower end 13A is fixed.

Figure 6:
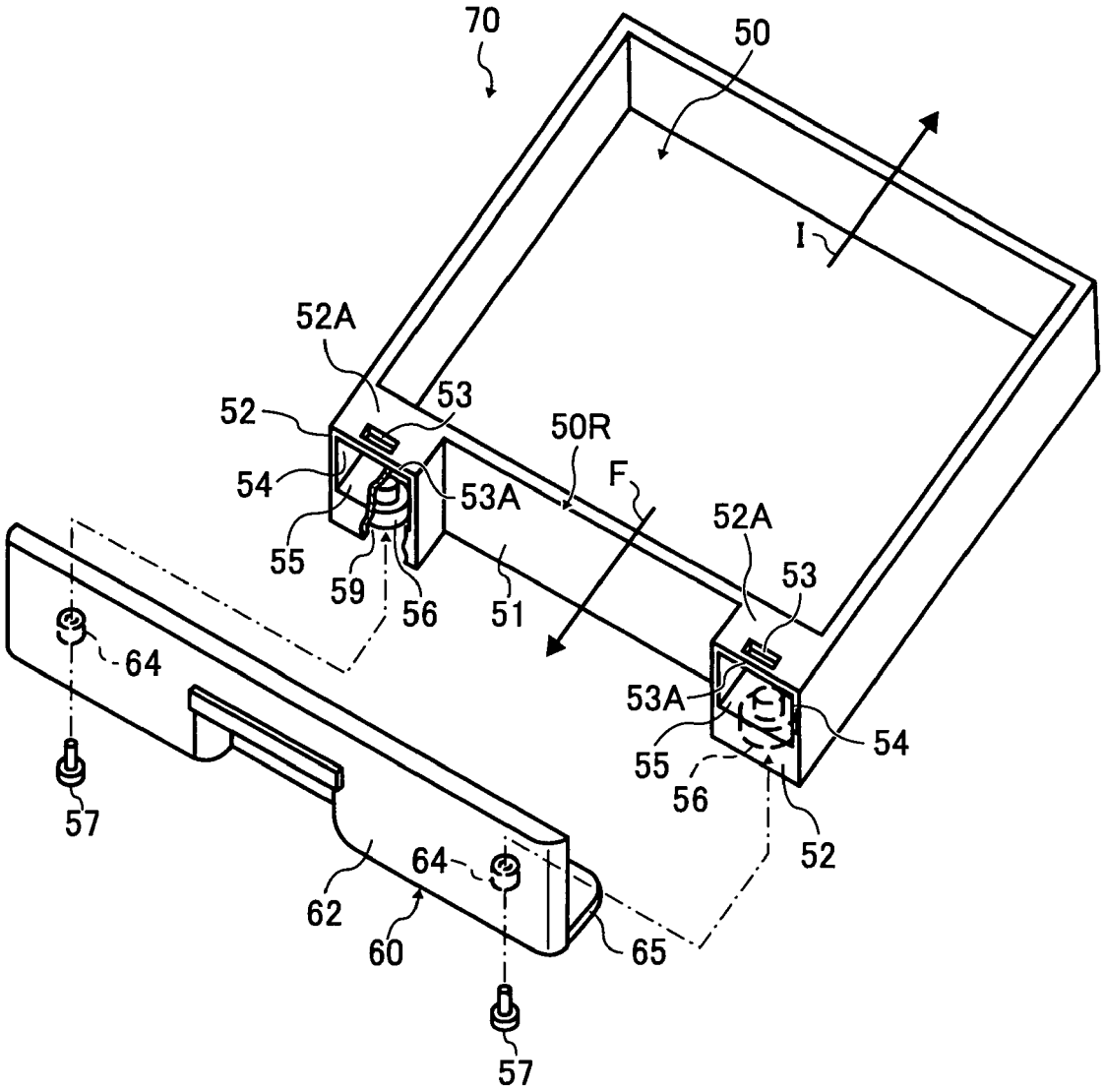
FIG. 6 is a perspective view of a paper supply cassette in accordance with a second embodiment of the invention.
Figure 7:
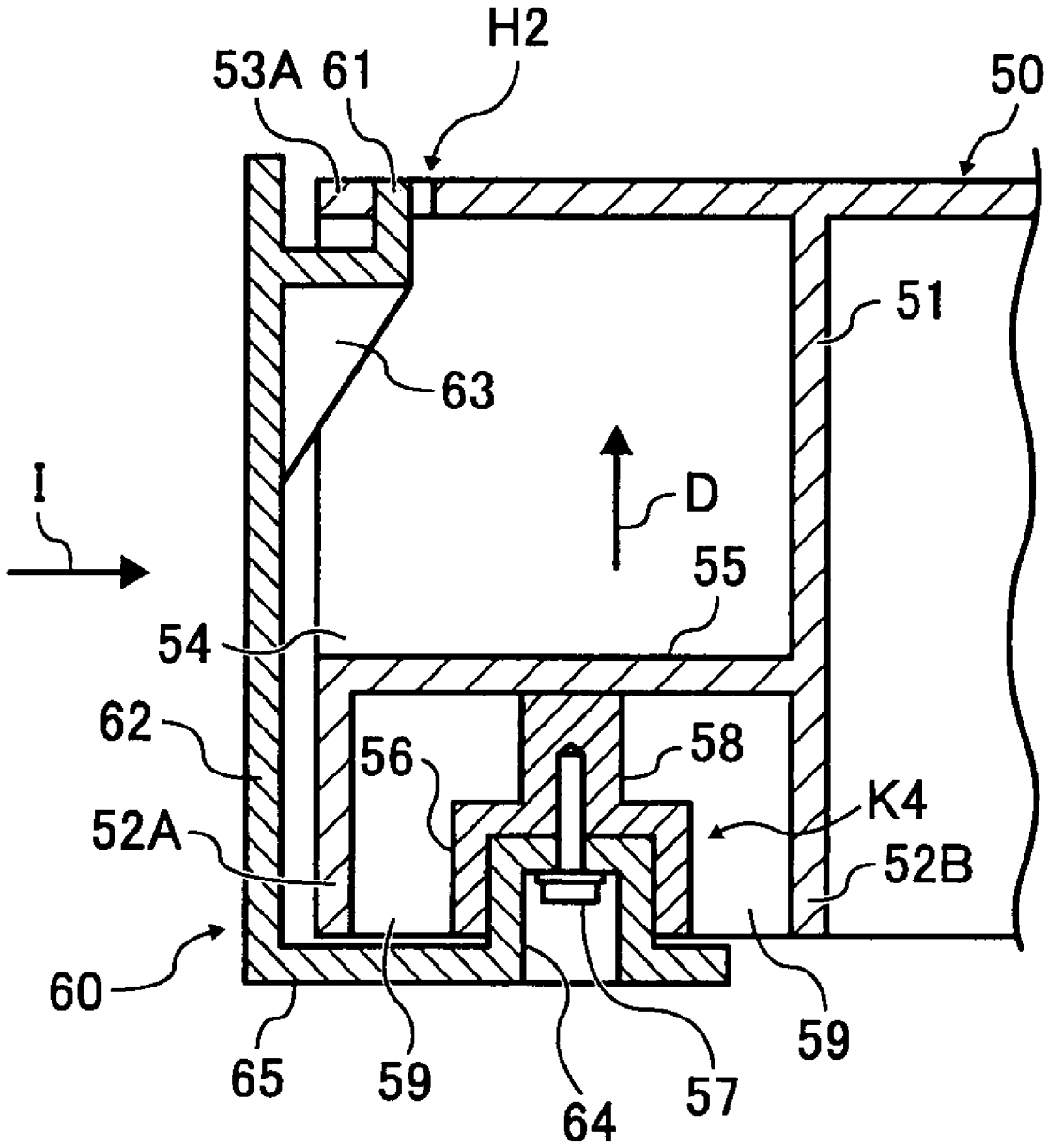
FIG. 7 is a cross-sectional view of an interconnection mechanism of a paper supply cassette in accordance with a second embodiment.

FIG. 6 is a perspective view of a paper supply cassette 70 in accordance with a second embodiment of the invention. FIG. 7 is a cross-sectional view of an interconnection mechanism of the paper supply cassette 70 in accordance with a second embodiment.

The paper supply cassette 70 in FIGS. 6 and 7 interconnects a tray 50 and a handle 60. The paper supply cassette 70 in FIG. 6 includes the tray 50 and the handle 60, as the paper supply cassette 3 does. The interconnection mechanism for the tray 50 and the handle 60 includes left and right connection portions K4 and a locking portion H2. Box shapes 52 are formed, respectively, on both of the left and right ends of a vertical wall 51 of an end 50R in the direction (also called "a drawing direction end 50R") of drawing the tray 50. The box shapes 52 of the tray 50 project in a drawing direction F of drawing the tray 50 from the vertical wall 51. A horizontal plate 55 of the box shapes 52 is open at its lower portion. Rectangular openings 53, which constitute one of the locking portion, are formed on upper walls 52A of the box shapes 52.

In FIG. 7, the tray 50 and the handle 60 are interconnected by the interconnection mechanism including the connection portions K4 and the locking portions H2. The locking portions H2 are composed of front end portions 53A of the apertures 53 and nail portions 61 of the handle 60. The nail portions 61 sandwich the front end portions 53A of the apertures 53 to project to the tray 50 of a vertical wall 62 of the handle 60 with a pressable separation. Reference numeral 63 is an enforcement portion for preventing a bending deformation of the nail portions 61. Upper end portions of the nail portions 61 are constructed to be identical with the surface of the upper walls 52A.

Square apertures 54 for inserting the nail portion 61 are formed on the vertical walls of the box shapes 52. Cylindrical portions 56 are established on the lower side of the horizontal plate 55 inside of the apertures 54. The cylindrical portions 56 are open in the lower direction. A boss 58 is formed on the cylindrical portions 56 from its base to upward, and has a screw hole for spirally providing a screw 57. Because the screw 57 is spirally provided from the lower side of the cylindrical portions 56, it cannot be seen from outside of the paper supply cassette 70. This is advantageous in terms of an external appearance of the tray 50. The outer circumference of the cylindrical portions 56 is integrally formed into the vertical wall 52A in all directions.

The connection portions of the handle 60 shown in FIGS. 6 and 7 are cylindrical protrusions 64 on the left and right ends thereof. The cylindrical protrusions 64 are connected in the cylindrical portions 56 to form the connection portions K4. The cylindrical protrusions 64 projects over the upper surface of horizontal plate 65 that extends from the lower end of the vertical wall 62 of the handle 60 to the tray 50. The cylindrical protrusions 64 have a screw hole at the bottom that is open to receive a screw 57. When the handle 60 is connected to the tray 50, the connection portions K4 and the locking portions H2 are connected in the upward direction D orthogonal to the attaching and detaching direction F and I of the paper supply cassette 70 with respect to the copying machine 1.

Consequently, even when the paper supply cassette 70, which is fully loaded with sheets of paper, is withdrawn by pulling out the handle 60, a force exerted by the pulling out is received by the connection portions K4 and the locking portions H2. Therefore, there is no possibility that the handle 60 is not separated from the tray 50.

When the tray 50 and the handle 60 shown in FIGS. 6 and 7 are interconnected, the handle 60 is moved in the insertion direction I toward the tray 50 so that the cylindrical protrusions 64 are located under the cylindrical portion 56 of the tray 50. The nail portion 61 of the handle 60 is inserted into the apertures 53 of the box shapes 52 to push the handle 60 in the upward direction D.

By doing so, the front end portions 53A of the apertures 53 are sandwiched between the nail portion 61 and the vertical wall 62, and the cylindrical protrusions 64 are also inserted into the cylindrical portion 56 of the tray 50. Thus, the connection portions K4, which include the cylindrical protrusions 64 and the cylindrical portion 56, are interconnected, and the locking portions H2, which are composed of the nail portions 61 on the left and right sides and the vertical wall 62, lock the front end portions 53A to be mutually connected. Then, after the screws 57 are put through the screw hole of the cylindrical protrusions 64, they are spirally mounted in the boss 51. This does not isolate the cylindrical protrusions 64 and the cylindrical portion 56, even when a force is applied in the upward and downward. Because a force in the attaching and detaching direction of the paper supply cassette 70 is received by a shear force of the screws 57, rigidity is considered to be high.

With regard to the paper supply cassette 70 in FIGS. 6 and 7, the interconnection mechanism for interconnecting the tray 50 and the handle 60 includes the connection portions K4, which includes the cylindrical protrusions 64 and the cylindrical portion 56, and a plurality of locking portions H2. The connection portions K4 and the locking portions H2 are connected by moving them in the upward direction that is not identical with the drawing direction F or insertion direction I of the tray 50 with respect to the copying machine 1. Thus, the handle 60 does not come off the tray 50 in attaching or detaching the paper supply cassette 70.

The interconnection of the connection portions K4 is performed by inserting the handle 60 from under the tray 50 and connecting the cylindrical protrusions 64 with the cylindrical portion 56. Therefore, even if a diagonally upward force is applied to the tray 50 when drawing the handle 60, the handle 60 does not come off the tray 50.

Since the connection portions K4 are constructed to be double cylindrical, high rigidity is obtained with respect to a shear force of a drawing force. This allows the tray 50 and the handle 60 to be easily individually designed even when a space between the tray 50 and the handle 60 becomes smaller by making compact the paper supply cassette 70. Moreover, sufficient strength can be obtained with respect to manipulation of the handle 60. Because the interconnection can be made smaller, precise molding is easily performed to improve the quality of an external appearance.

An explanation is made of the copying machine, the paper supply cassette, etc., of the embodiments in accordance with the invention. However, the structure of the paper supply cassette in accordance with the invention is not limited to the one described above. That is, for example, in the paper supply cassette in which the tray and the handle, as long as the interconnection is established in the direction orthogonal (from downward to upward, or vice versa) to the attaching and detaching direction of the paper supply cassette, the separation between the tray and the handle can be safely prevented. The paper supply cassette can be downsized as the copying machine is downsized. The design change of the handle is quite easy, and the quality of the external appearance of the handle can be improved.

The interconnection mechanism interconnects the recording medium storage unit and the handle unit from a direction that is different from the attachable and detachable direction of the recording medium storage unit into the apparatus. Therefore, when drawing the recording medium storage unit with the handle unit held, connection never comes off, because a drawing force applied to the handle unit is pointed to a direction that is different from a direction in which the connection portions are connected or the locking portions are locked. This allows the interconnection mechanism to be small and safely fixed without easily coming off.

The connection portions include cylindrical portions located inside and cylindrical portions located outside. When they are connected, the cylindrical portions become double. Therefore, when drawing the recording medium storage container from the apparatus, the recording medium storage container is not easily deformed or damaged by a force applied to the cylindrical portions, but instead is firmly interconnected.

The connection portions are connected spirally from a direction that is different from the attachable and detachable direction toward the apparatus. A force applied for attaching or detaching the recording medium storage container is not directly applied to the screw to guarantee the rigidity.

When drawing the recording medium storage unit from the apparatus, an operator extends his hand from the top to the bottom of the recording medium storage unit. When drawing the handle unit, a traction force from downward to diagonally upward is applied to the recording medium storage unit. However, because the connection portions are connected with the recording medium storage unit downward, the handle unit does not come off from the recording medium storage unit even if the handle unit is pulled out.

Because a pair of the connection portions is formed on the left and right ends on each of the recording medium storage unit and the handle unit, an almost equal force is applied to the left and right portions of the handle unit when drawing the handle unit. Accordingly, the handle unit can be prevented from being deformed with a bias to the left or right.

Because a pair of the locking portions is formed on the left and right ends on each of the recording medium storage unit and the handle unit, an almost equal force is applied to the left and right portions of the handle unit when drawing the handle unit. Consequently, the handle unit can be prevented from being deformed in a direction separating from the recording medium storage unit.

Once the connection portions are connected, disconnecting is constrained. Hence, the connection force is increased, and a fastener such as a screw is not needed. This can reduce parts cost and working labor, and as a result manufacturing cost.

It is possible to make compact the recording medium storage container and to produce a strong interconnection and a good external appearance with a simple structure.

While preferred embodiments of the invention have been described and illustrated above, it should be understood that these are exemplary of the invention and are not to be considered as limiting. Additions, omissions, substitutions, and other modifications can be made without departing from the spirit or scope of the present invention. Accordingly, the invention is not to be considered as being limited by the foregoing description, and is only limited by the scope of the appended claims.

What is claimed is:

1. A recording medium storage container for an apparatus, the container comprising:

a recording medium storage unit for storing a recording medium, the recording medium storage unit being attachable to and detachable from the apparatus; and a handle unit for drawing the recording medium storage unit, wherein the recording medium storage unit and the handle unit are individually formed and constitute the recording medium storage container using an interconnection mechanism, the interconnection mechanism including the following, connection portions for connecting the recording medium storage unit and the handle unit from a direction that is different from a attachable and detachable direction of the recording medium storage unit into the apparatus, and locking portions for simultaneously locking the recording medium storage unit and the handle unit at the time of the connecting, and box shapes formed on both a left and a right end of a first vertical wall of the recording medium storage unit, the box shapes configured to protrude from the first vertical wall toward the detaching direction of the recording medium storage unit, wherein each box shape includes horizontal upper and lower plates and two vertical side walls, wherein the connection portions and the locking portions are formed as one pair on the left and on the right ends of the handle unit, wherein the connection portions and the locking portions of the recording medium storage unit are insertable into the box shapes, and wherein each box shape includes an aperture between the two vertical side walls, the aperture facing the detaching direction of the recording medium storage unit, the locking portions being configured to insert into the respective apertures.

2. The recording medium storage container of claim 1, wherein the connection portions include cylindrical portions vertically projecting from the handle unit.

3. A recording medium storage container as recited in claim 1, wherein the connection portions are connected by a spiral screw from a direction that is different from the attachable and detachable direction toward the apparatus.

4. The recording medium storage container of claim 1, wherein the connection portions include cylindrical portions projecting vertically from the handle unit, the cylindrical portions being insertable into the upper plates of the box shapes in a downward direction.

5. The recording medium storage container of claim 1, wherein the locking portions include a vertically projecting nail portion and a horizontal reversed portion.

6. The recording medium storage container of claim 1, wherein the connection portions includes a disconnection prevention mechanism that prevents the recording medium storage unit and the handle unit being disconnected once they are connected.

7. An image forming apparatus comprising:

a recording medium storage container as recited in claim 1;

a transfer unit to transfer a toner image from a photosensitive member to a recording medium; and a conveyance arrangement to transfer a recording medium from the recording medium storage container to the transfer unit.

8. The image forming apparatus of claim 7, further comprising:

an image forming unit to form a toner image on the photosensitive member.

9. The recording medium storage of claim 1, wherein the upper plate of each box shape includes a vertically projecting concave portion, and the lower plate of each box shape includes a vertically projecting lower end portion.

10. The recording medium storage of claim 4, wherein the vertically projecting cylindrical portions of the handle unit are insertable into vertically projecting concave portions located in the upper plate of each box shape.

11. The recording medium storage of claim 5, wherein the lower plate of each box shape includes a vertically projecting lower end portion configured to capture the nail portion of the locking portion of the handle, the lower end portion including a slit configured to accept the horizontal reversed portion of the locking portion.

12. A recording medium storage container for an apparatus, the container comprising:

a storage unit for storing a recording medium, the storage unit being attachable to and detachable from the apparatus;

box shapes on a first vertical wall of the storage unit, each box shape including an upper and lower plate and two vertical side walls;

a vertically projecting concave portion on the upper plate of each box shape;

an aperture located on each box shape, the aperture facing a detaching direction;

vertically projecting cylindrical portions on the handle, the cylindrical portions insertable into the concave portion of each box shape; and locking portions located on the handle and below each cylindrical portion, the locking portions including a vertically projecting nail portion that is insertable into the aperture of each box shape.

13. The recording medium storage container of claim 12, further comprising:

a vertically projecting lower end portion on the lower plate of each box shape, the lower end portion configured to capture the nail portion of the locking portion of the handle.

14. The recording medium storage container of claim 13, further comprising:

a slit on the lower end portion of each box shape, the slit configured to accept the horizontal reversed portion of the locking portion.

* * * * *